US006185982B1

(12) United States Patent
Ballard et al.

(10) Patent No.: US 6,185,982 B1
(45) Date of Patent: Feb. 13, 2001

(54) APPARATUS FOR SECURING VEHICLE

(75) Inventors: James G. Ballard; James C. Graham, both of Waukesha, WI (US)

(73) Assignee: Hein Werner Corporation, WI (US)

( * ) Notice: Under 35 U.S.C. 154(b), the term of this patent shall be extended for 0 days.

(21) Appl. No.: 09/452,407

(22) Filed: Dec. 1, 1999

(51) Int. Cl.[7] ..... B21J 13/08

(52) U.S. Cl. ..... 72/457; 72/705

(58) Field of Search ..... 72/457, 705; 248/352, 248/354.1, 354.3

(56) References Cited

U.S. PATENT DOCUMENTS

| | | | | |
|---|---|---|---|---|
| 4,519,236 | * | 5/1985 | Celette | 72/705 |
| 4,941,765 | * | 7/1990 | Horan et al. | 72/705 |
| 5,054,307 | | 10/1991 | Wisner | 72/457 |
| 5,131,257 | * | 7/1992 | Mingardi | 72/705 |
| 5,413,303 | | 5/1995 | Lee et al. | 248/354.1 |
| 5,417,094 | | 5/1995 | Chisum | 72/34 |
| 5,613,397 | * | 3/1997 | Johansson | 72/705 |

* cited by examiner

*Primary Examiner*—Ed Tolan
(74) *Attorney, Agent, or Firm*—Foley & Lardner

(57) ABSTRACT

An apparatus for securing a vehicle to a vehicle repair system with the vehicle repair system having a work surface. The apparatus comprises a frame removably mounted on the work surface with the support base slidingly attached to the frame with the support base having a release handle and an upright column. A lock plate having a lock plate bore sized to receive the upright column is placed over the upright column of the support base and secured to the frame by a drive nut threadingly mounted to the upright column to secure the lock plate against the frame and draw the support base against the frame. A clamp support removably coupled to the upright column of the support base is coupled to a vehicle retainer. The vehicle retainer engages a vehicle securing area on a vehicle being repaired on the vehicle repair system. The frame is secured to the vehicle repair system work surface by a single bolt. Also, the vehicle retainer is secured to the vehicle by a single bolt, with the frame bolt, vehicle retainer bolt and the drive nut being tightened by a single tool utilized by an operator of the vehicle repair system. The support base is also provided with a release handle and is provided with a position slot having the first position in which the support base remains attached to the frame in a second position in which the support base can be removed from the frame. A second, third or fourth apparatus for securing a vehicle to a vehicle repair system with each apparatus mounted on the work surface in a spaced relationship from each other. There is also provided a method for securing a vehicle to the vehicle repair system having a work surface using an apparatus for securing the vehicle.

15 Claims, 7 Drawing Sheets

APPARATUS FOR SECURING VEHICLE

FIELD OF THE INVENTION

The present invention relates to vehicle repair systems, and more particularly to an apparatus for securing a vehicle to a work surface of a vehicle repair system.

BACKGROUND OF THE INVENTION

With new vehicle body styles and variations in manufacturing techniques being introduced in the manufacture of vehicles it is necessary to provide a specific set of vehicle retainers for each of the various body styles of vehicles in order to properly secure a damaged vehicle to a vehicle repair system. In order to repair a damaged vehicle, it is important for the vehicle to be securely mounted on the vehicle repair system so that the exact location of the data points on the vehicle can be measured and repaired. Various types of vehicle repair systems are utilized such as a vehicle repair rack, a repair bench, or a floor system utilized rails or anchor pots. A conventional attachment system for securing a vehicle to a vehicle repair system such as a rack, requires four double clamp type attachment devices each of which is attached to the pinch weld of a vehicle that runs along the bottom of the rocker panel of vehicle. As the body styles have changed, the pinch weld has become shorter, relocated, and in some instances eliminated, making it necessary to use a different attachment system for each type or body of a vehicle in order to hold the vehicle in the fixed position necessary during a repair operation.

Although a vertical pinch weld remains a standard point for clamping many vehicles, horizontal pinch welds and in some instances pinch welds set in an angle from the vertical are being used. In addition, some car manufacturers have introduced jack mounts such as a pin engaging a hole or a suspension pocket formed in the frame of the vehicle which requires another type of vehicle retainer. During a repair operation, each vehicle must be anchored at least two separate points and more typically at four separate points thereby requiring a vehicle repair shop to inventory at least one attachment system for each type of vehicle. This can be costly and requires considerable storage place for each attachment system. In addition, in conventional vehicle retainer systems a multitude of bolts are used for attaching the system to the vehicle repair system, typically in a plurality of holes in the work surface of the vehicle repair system and also requires a multitude of bolts to secure the vehicle retainer to the vehicle.

Thus, there is a need for an apparatus for securing a vehicle to a vehicle repair system that minimizes the number of bolts needed to secure the vehicle to the apparatus. There is a further need for an apparatus for securing a vehicle on a vehicle repair system that is infinitely adjustable on the work surface of the repair system and does not require a multitude of bolts for securing the apparatus to the work surface. There is also a need for an interchangeability of vehicle retainers to accommodate different ways of securing different types of vehicles to the apparatus for the repair process. There is a further need to reduce the amount of time necessary to fix the apparatus for securing a vehicle to the vehicle repair system and securing the vehicle to the apparatus itself, preferable by reducing the number of bolting operations to secure the vehicle.

SUMMARY OF THE INVENTION

One embodiment of the invention relates to an apparatus for securing a vehicle to a vehicle repair system with the vehicle repair system having a work surface. The apparatus comprises a frame removably mounted on the work surface with the support base slidingly attached to the frame with the support base having a release handle and an upright column. A lock plate having a lock plate bore sized to receive the upright column is placed over the upright column of the support base and secured to the frame by a drive nut threadingly mounted to the upright column to secure the lock plate against the frame and draw the support base against the frame. A clamp support removably coupled to the upright column of the support base is coupled to a vehicle retainer. The vehicle retainer engages a vehicle securing area on a vehicle being repaired on the vehicle repair system. The frame is secured to the vehicle repair system work surface by a single bolt. Also, the vehicle retainer is secured to the vehicle by a single bolt, with the frame bolt, vehicle retainer bolt and the drive nut being tightened by a single tool utilized by an operator of the vehicle repair system. The support base is also provided with a release handle and is provided with a position slot having the first position in which the support base remains attached to the frame in a second position in which the support base can be removed from the frame. A second, third or fourth apparatus for securing a vehicle to a vehicle repair system can be used with each apparatus mounted on the work surface in a spaced relationship from each other. There is also provided a method for securing a vehicle to the vehicle repair system having a work surface using an apparatus for securing the vehicle.

DETAILED DESCRIPTION OF THE PREFERRED EMBODIMENTS

Figure 1:
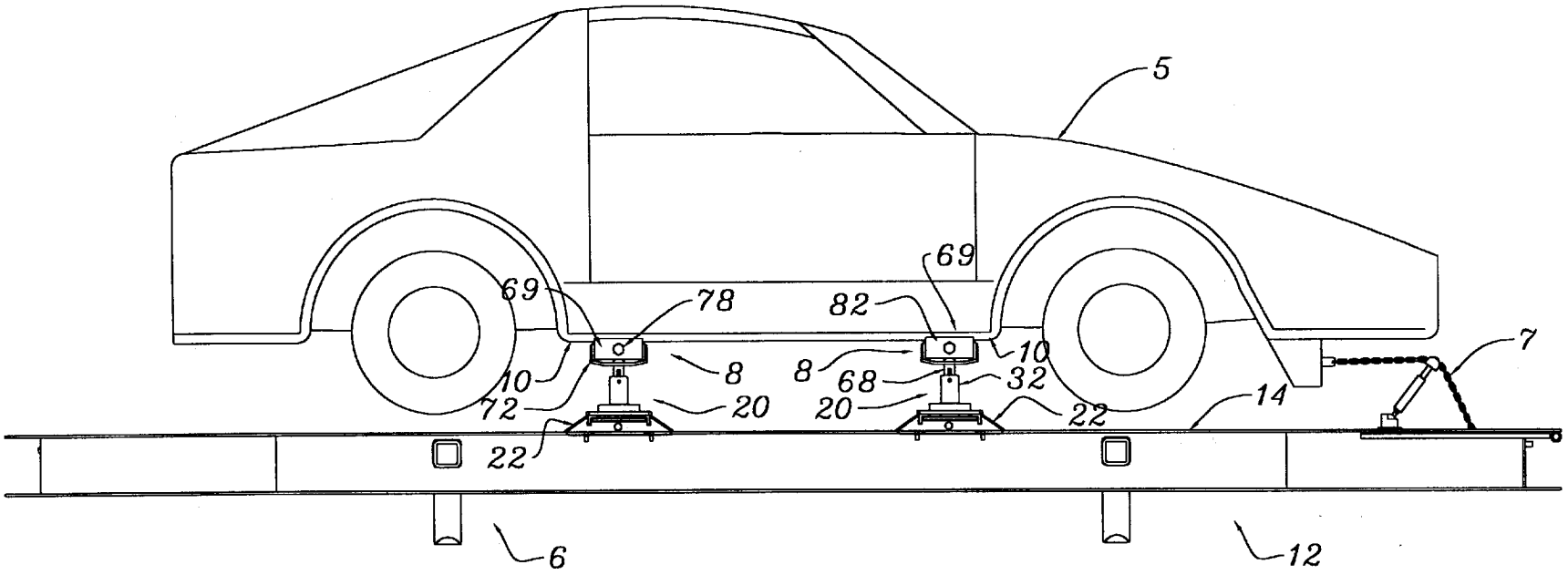
FIG. 1 is a side plan view of a vehicle secured to a vehicle repair rack type vehicle repair system by two of the present apparatus for securing vehicle assemblies.

Referring to FIG. 1 there is illustrated a vehicle (5) mounted on a vehicle repair system (6) with two of the present apparatus for securing vehicle (20) assemblies. The illustrated vehicle repair system (6) is of the vehicle repair rack (12) type (also see FIG. 2). The vehicle repair rack (12) typically is supported above a floor or supporting surface as in an automobile repair facility. It may be supported by several pairs of stationary legs, or by leg sets that are moved from a lowered position to a raised position by hydraulic or air cylinders or the rack may be raised by a scissors, a parallelogram or other type of lift. Other types of vehicle repair systems that can utilize the present apparatus for securing vehicle (20) include a bench system or a rail system. A rail system can be mounted above the floor of the repair facility or may be mounted in the floor of the repair facility. The assignee of the present disclosure manufactures and distributes at least one type of each of the above described vehicle repair systems.

Figure 2:
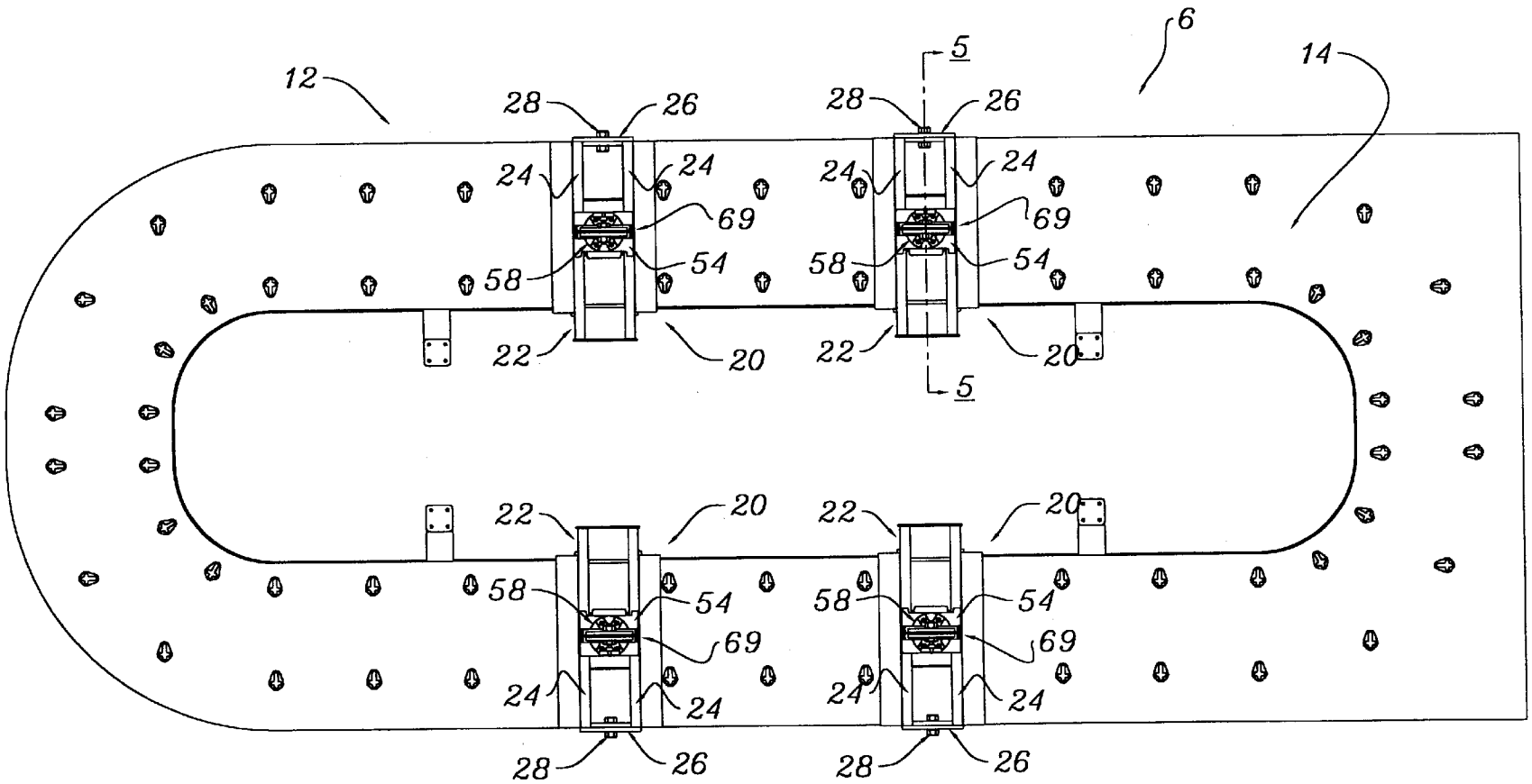
FIG. 2 is a top plan view of a vehicle repair rack with four of the present apparatus for securing vehicle mounted on the work surface of the vehicle repair rack.

The illustrated vehicle repair rack (12) includes a work surface (14) which in some cases is provided with a plurality of holes for engaging chains used in the repair procedure of the vehicle (See FIG. 2). The vehicle repair procedure typically uses a vehicle straightening assembly (7) such as the illustrated chain and hydraulic cylinder. However, it should be understood that other types of vehicle straightening assemblies (7) can be utilized such as a tower mounted on the vehicle repair system (6) or mounted on the floor of the repair facility. During a repair procedure, regardless of the type of vehicle repair system (6) or the vehicle straightening assembly (7) utilized by an operator of a vehicle repair facility, the vehicle (5) must be secured to the vehicle repair system (6) to withstand the forces applied to the vehicle by the vehicle straightening assembly (7) during the repair procedure. The present apparatus for securing a vehicle (20) facilitates the securing of the vehicle to the vehicle repair system (6) for such purposes. In the typical configuration, the apparatus for securing vehicle (20) are mounted on the vehicle repair rack (12) and secured to the work surface (14) of the vehicle repair system (6). Each vehicle (5) typically has a designated vehicle securing area (8) to which an apparatus for securing vehicle (20) engages the vehicle (5). Although a passenger automobile is illustrated in FIG. 1, it should be understood that the present apparatus for securing vehicle (20) can be utilized with most types of vehicles including trucks, busses and other types of vehicles that are mounted on a vehicle repair system (6).

During the repair procedure, the vehicle (5) usually is suspended above the work surface (14) of the vehicle repair rack (12) during the repair procedure. The apparatus for securing vehicle (20) not only secures the vehicle to the vehicle repair system (6) but also supports the vehicle above the work surface (14) as illustrated in FIG. 1. A typical arrangement for a vehicle repair procedure utilizes four apparatus for securing vehicle (20) mounted on the work surface (14) as shown in FIG. 2 with each apparatus for securing vehicle (20) engaging the designated vehicle securing area (8) of the specific vehicle (5) being repaired.

Figure 3:
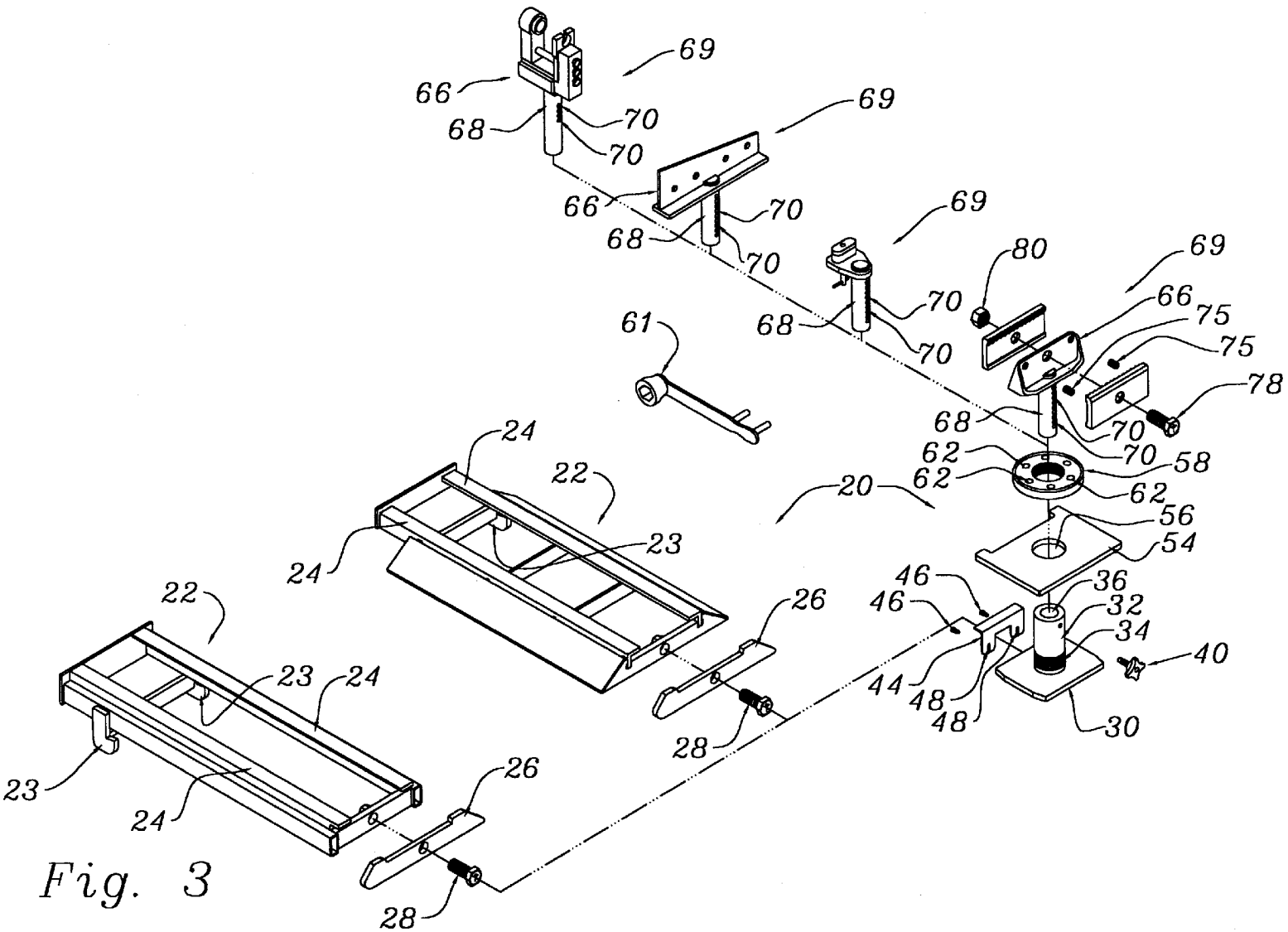
FIG. 3 is a perspective exploded view of the present apparatus for securing vehicle, with two embodiments of frame and four embodiments of a vehicle retainer mounted on a clamp column which is coupled to the upright column.
Figure 4:
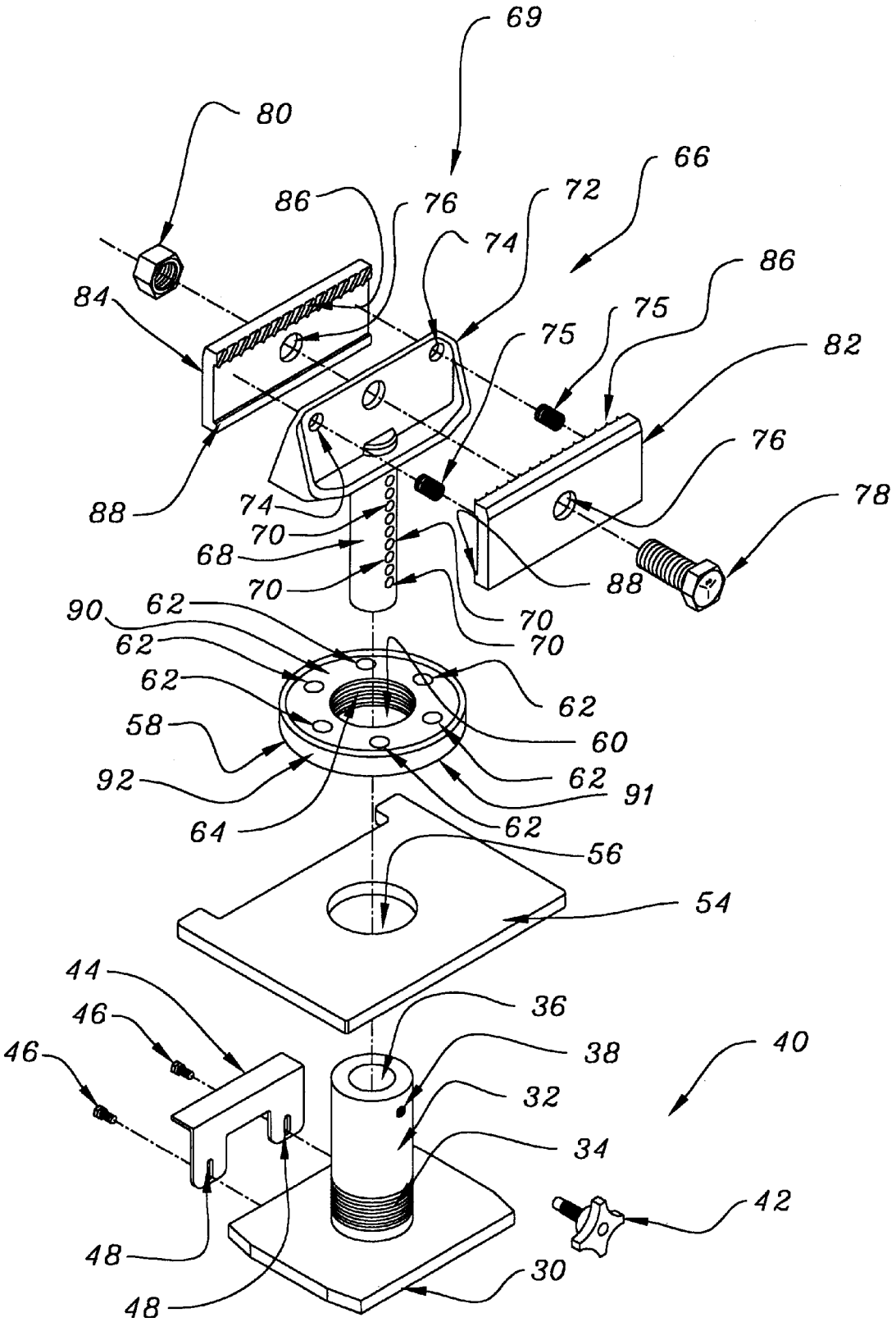
FIG. 4 is a perspective exploded view of an embodiment of the apparatus for securing vehicle illustrating the pinch weld clamp type vehicle retainer.

Referring to FIGS. 3 and 4, there is illustrated an apparatus for securing a vehicle (20) to a vehicle repair system (6). The apparatus (20) comprises a frame (22) removably mounted on the work surface (14) of the vehicle repair system (6). FIG. 3 illustrates two embodiments of the frame (22). The frame (22) is provided with two elongated substantially parallel frame members (24) which are maintained in a spaced relationship by several traverse members. One end of the frame (22) is provided with a plurality of frame retainer members (23) which engage the vehicle repair rack (1 2), typically the underside of the work surface (14), to assist in maintaining the frame (22) in a selected position on the work surface (14). The frame retainer member (23) can be configured to engage the work surface of the particular vehicle repair system being utilized. The other end of the frame (22) is provided with a frame clamp (26) and a frame bolt (28). The frame clamp (26) engages the work surface (14) of the vehicle repair system (6) and when the frame bolt (28) is tightened the frame (22) is fixed in position on the work surface (14) of the vehicle repair system (6). The frame clamp (26) can be configured to engage the work surface of the particular vehicle repair system being utilized. In operation, the operator of the vehicle repair system (6) moves each frame (22) to align with the vehicle securing area (8) of the vehicles (5) being repaired and when so aligned, the operator tightens the frame bolt (28) thereby fixing the position of the frame (22) of the apparatus for securing vehicle (20). Such arrangement allows for an infinitely adjustable positioning method of the frame (22) and thereby not dependent upon the several holes placed in the work surface (14) used for chains to secure the vehicle (5).

A support base (30) slidingly attaches to the frame (22) with the support base (30) having a release handle (44) in an upright column (32). The support base (30) engages the elongated frame members (24) of the frame (22). The upright column (32) is provided with an interior clamp support bore (36) and an exterior thread portion (34). The release handle (44) is provided with a position slot (48) which provides a first position (50) and a second position (52) for the release handle (44). The operation of the release handle (44) will be described below. A lock plate (54) having a lock plate bore (56) sized to receive the upright column (32) is placed over the support base (30) and rests on the elongated frame member (24) of the frame (22). This arrangement sandwiches the elongated frame member (24) between the support base (30) and the lock plate (54). A drive nut (58) is threadingly mounted on the upright column (32). The drive nut (58) is provided with a drive nut bore (60) having a thread portion (64) corresponding to the thread portion (34) of the upright column (32). An operator slides the drive nut (58) onto the upright column (32) and tightens the drive nut (58) utilizing a tool (61). The action of tightening the drive nut (58) while mounted on the upright column (32) secures the lock plate (54) against the elongated frame members (24) of the frame (22) and draws the support base (30) up against the elongated frame member (24) of the frame (22) thereby securing the assembly in the position along the frame (22) as selected by the operator (See FIG. 5). The drive nut (58) is provided with a plurality of drive holes (62). It should be understood that the drive nut (58) could also be provided with a member, such as pins, that are engaged by the tool (61) to tighten the drive nut. The drive nut (58) has a top surface (90), a bottom surface (91) and a sidewall (92). The illustrated drive nut (58) is of a circular configuration however, it should be understood that the drive nut (58) may be a polygon shape. The drive holes (62) are provided in the top surface (90) of the illustrated drive nut (58) but it should be understood that the drive holes (62) can also be provided in the sidewall (92) of the drive nut (58). The drive holes (62) can be through holes or blind holes and they may be of any suitable configuration engageable by the tool (61) used to tighten the drive nut (58). It is also contemplated that a suitable wrench, such as a monkey wrench or a spanner wrench can also be utilized to tighten the drive nut (58). A clamp support (66) is removably coupled to the upright column (32) with the vehicle retainer (69) coupled to the clamp support (66). FIG. 3 illustrates several types of a vehicle retainer (69) which can be mounted on the clamp support (66). The clamp support (66) is coupled to a clamp column (68) which is inserted into the clamp support bore (36) of the upright column (32). The clamp column (68) is provided with a plurality of height adjustment holes (70) along its length. The upright column (32) is provided with a location hole (38) which when aligned with the height adjustment holes (70) can be used to fix the upright column (32) in a position by a support lock (40). It should be understood that the support lock (40) can be of any suitable configuration such as the illustrated hand knob (42) or can be a spring and pin assembly or a simple pin that when inserted in the location hole (38) engages the selected height adjustment hole (70) in the clamp column (68) thereby fixing the clamp support (66) at a selected height.

The vehicle retainer (69) can be of the type that engages the rear spring brackets of a vehicle such as a truck or engages slots located in the vehicle such as those used in selected sport vehicles or engages pins such as on certain foreign made vehicles. The vehicle retainer (69) can also be of the type that engages the pinch weld of a vehicle. Such pinch weld clamp is illustrated in FIG. 4. In the illustrated pinch weld clamp, the clamp support (66) is intermediate between a first clamp member (82) and a second clamp member (84) with the clamp members (82, 84) and the clamp support (66) reciprocally secured by a single clamp bolt (78) mounted in a bolt hole (76) in each clamp member (82, 84) and the clamp support (66). There is also provided at least one pressure spring (75) positioned between the clamp members (82, 84). The clamp wall (72) is provided with a spring orifice (74) which allows the spring (75) to contact both the first clamp member (82) and the second clamp member (84) and provide a bias force between the two members. It is contemplated that several springs can be used between the clamp members (82, 84) and the clamp wall (72) without utilizing a spring orifice. Springs other than the cylindrical compression spring can be utilized. The single clamp bolt (78) passes through the bolt hole (76) and engages a clamp nut (80). The operator, after aligning the frame (22) and the support base (30) and the height of the clamp support (66) with the vehicle securing area (8) of the vehicle (5) secures the pinch weld clamp to the pinch weld of the vehicle (5) by tightening the clamp bolt (78). A grip surface (86) on each clamp member (82, 84) contacts the pinch weld (of the vehicle securing area (8)) as the operator tightens the clamp bolt (78). The grip surfaces (82) of the clamp members (82, 84) are moved towards each other with additional leverage provided by a fulcrum ledge (88) provided on each clamp member (82, 84) with the clamp members pressing the pressure spring (75). In the preferred embodiment, two pressure springs (75) are utilized to equalize the force along the grip surface (86) of each clamp member (82, 84) as the single clamp bolt (78) is tightened. It should be understood that the tool (61) utilized to tighten the frame bolt (28) against the frame clamp (26) and to tighten the drive nut (58) against the lock plate (54) is used to tighten the clamp bolt (78). Therefore, an operator of the present apparatus for securing vehicle (20) only needs one tool to tighten three bolts to secure a vehicle (5) to the vehicle repair system (6).

As mentioned above, a typical set up during a vehicle repair procedure, utilizes four apparatus for securing vehicle (20) placed on the work surface (14) of the vehicle repair system (6). Some procedures will utilize two apparatus for securing vehicle (20) with the second apparatus mounted on the work surface (14) in a spaced relationship from the first apparatus. The two apparatus for securing vehicle can be mounted on the same side of the vehicle (5) as illustrated in FIG. 1 or traverse to each other as illustrated in FIG. 2.

Figure 5:
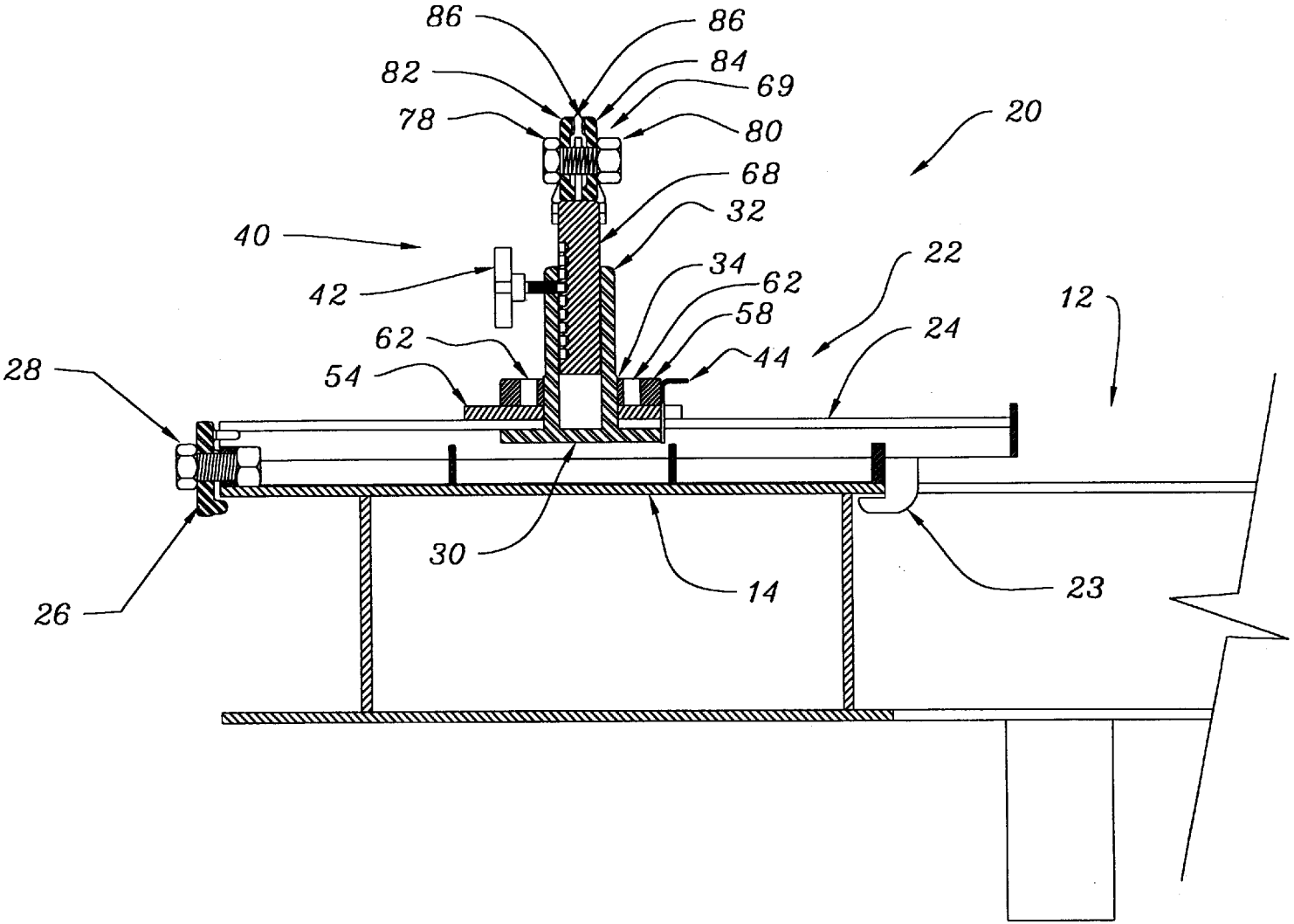
FIG. 5 is a partial cross-sectional view of the apparatus for securing vehicle, along the lines 5—5, illustrated in FIG. 2.
Figure 6:
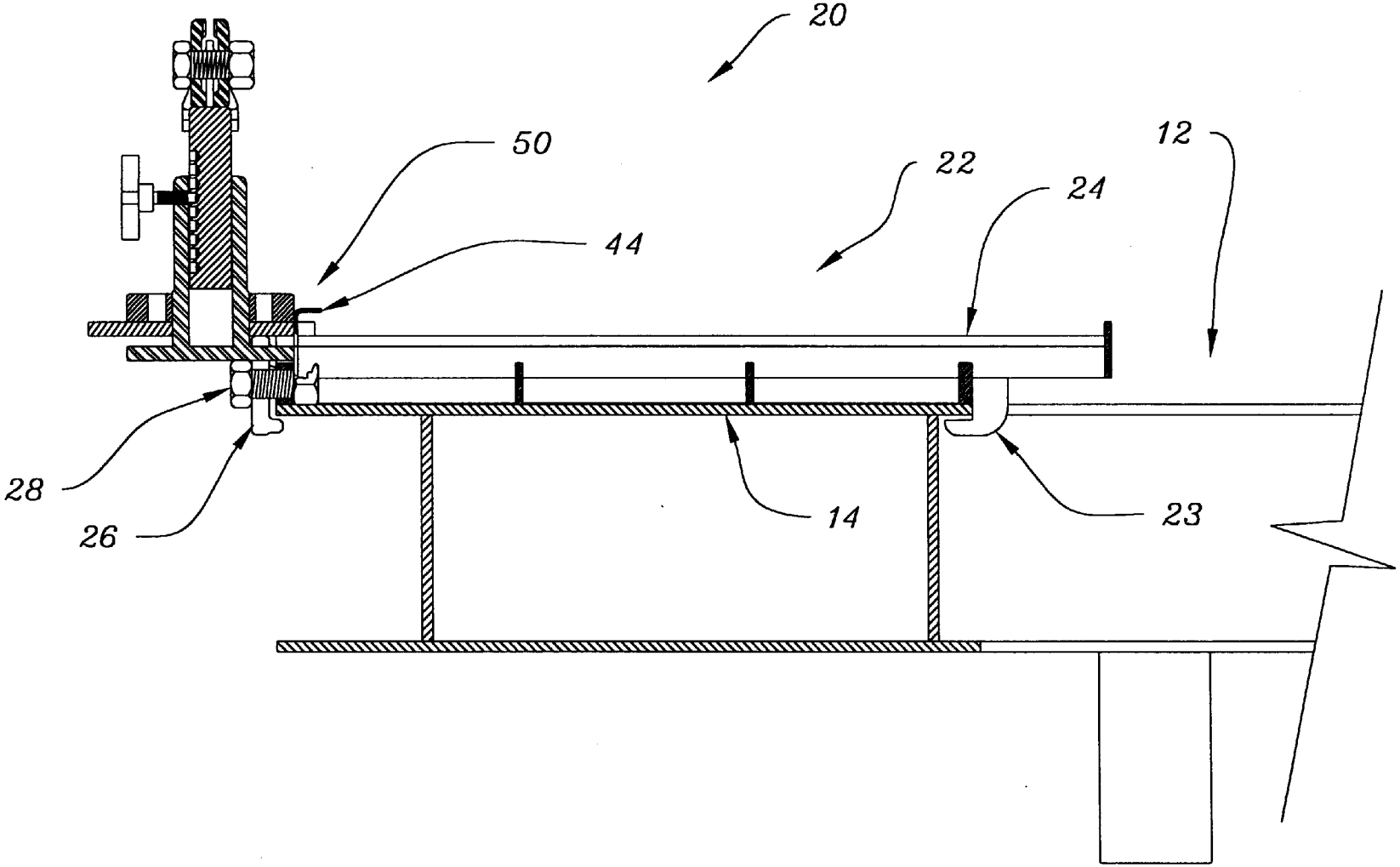
FIG. 6 is a partial cross-sectional view of the apparatus for securing vehicle illustrated in FIG. 5 with the release handle in the first position.
Figure 7:
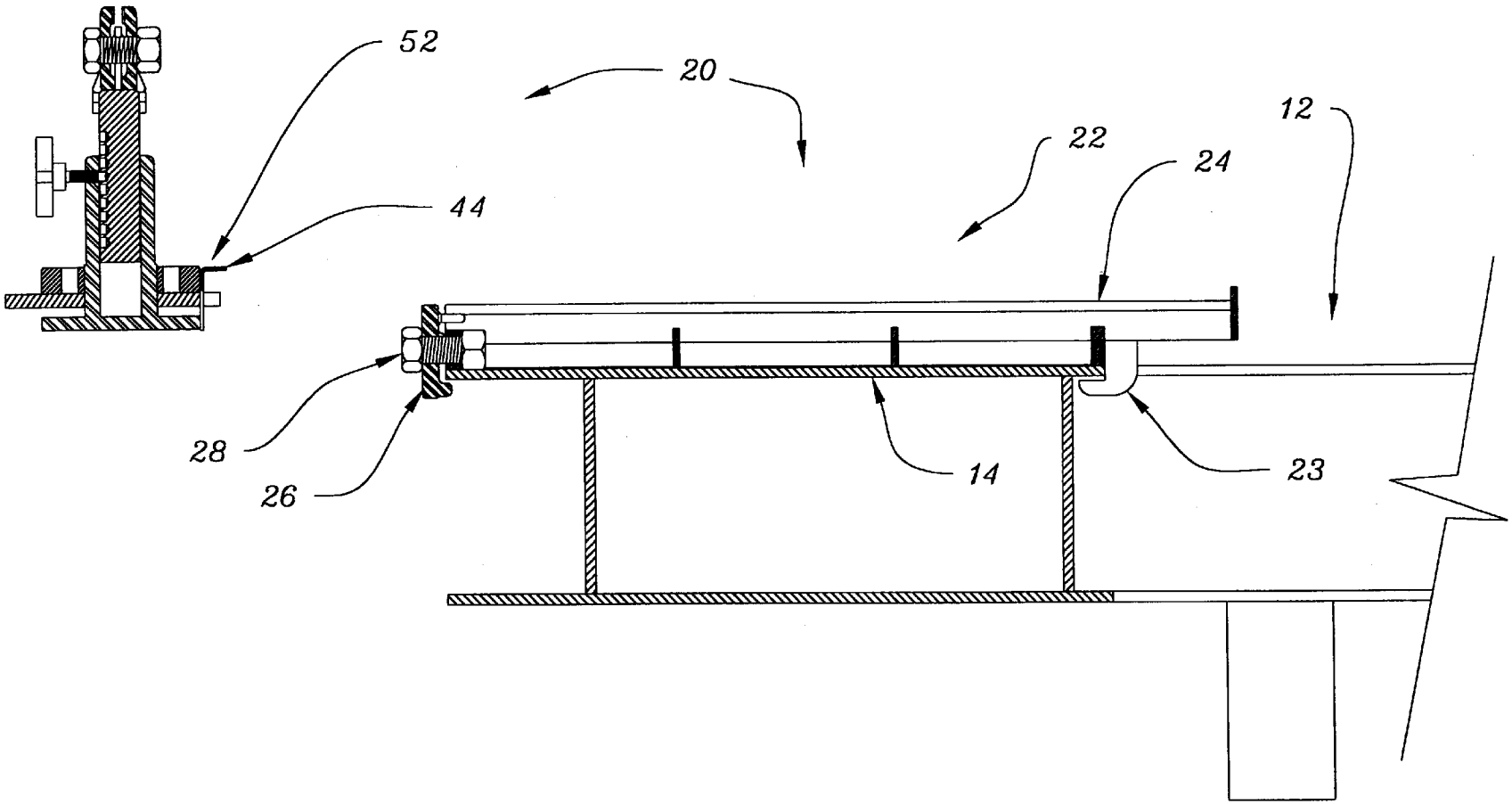
FIG. 7 is a partial cross-sectional view of the apparatus for securing vehicle illustrated in FIG. 5 with the release handle in the second position.

The apparatus for securing vehicle (20) is provided with a release handle (44) which handle is provided with a position slot (48) having a first position (50) and a second position (52). The preferred embodiment of the present apparatus for securing vehicle (20) is provided with two position slots (48). The release handle (44) is mounted to the support base (30) by one or more fasteners (46) which secure the release handle (44) to the support base (30) through the position slots (48). FIG. 6 illustrates the present apparatus for securing vehicle (20) mounted on a work surface (14) of the vehicle repair rack (12) with the release handle (44) in the first position (50) in which the support base (30) remains attached to the frame (22). In this configuration a vehicle can be moved onto the work surface (14) without having to remove the apparatus for securing vehicle (20) from the vehicle repair rack (12). One embodiment of the frame (22) provides ramps to facilitate the movement of the vehicle across the work surface (14) of the vehicle repair rack (12). However, when the release handle (44) is in the second position (52) the support base (30) can be removed from the frame (22) as illustrated in FIG. 7. FIG. 5 illustrates the support base (30) and the pinch weld clamp type vehicle retainer (69) located in the typical position for engaging the vehicle securing area (8) of the vehicle (5).

Thus, it should be apparent there has been provided in accordance with the present invention an apparatus for securing the vehicle to the vehicle repair system. While several embodiments of the present invention have been disclosed and described in detail herein, various modifications may be made. For example, the apparatus for securing vehicle can be mounted on an in-floor track system or can be mounted on a floor and secured by an anchor pot apparatus. By way of further modification, a hydraulic cylinder or a pneumatic cylinder could be coupled to the clamp column (68) to adjust the height of the clamp support (66) and the vehicle retainer (69). Further, different types of vehicle retainers can be mounted on the clamp support (66) to accommodate a particular vehicle being repaired on a selected vehicle repair system (6). Such modifications and variations in use are intended to fall within the scope of the appended claims.

What is claimed is:

1. An apparatus for securing a vehicle to a vehicle repair system with the vehicle repair system having a work surface, the apparatus comprising:

a frame removably mounted on the work surface;

a support base slidingly attached to the frame, with the support base having a release handle and an upright column;

a lock plate having a lock plate bore sized to receive the upright column;

a clamp support removably coupled to the upright column;

a vehicle retainer coupled to the clamp support; and, a drive nut threadingly mounted to the upright column to secure the lock plate against the frame and draw the support base against the frame.

2. The apparatus of claim 1, wherein the drive nut is substantially round and has a top surface, a bottom surface and a side wall, and the drive nut is provided with a plurality of drive holes.

3. The apparatus of claim 2, wherein the drive holes are in one of the top surface and the side wall.

4. The apparatus of claim 1, wherein the frame is provided with a frame clamp and a frame bolt.

5. The apparatus of claim 1, wherein the release handle is provided with a position slot having a first position in which the support base remains attached to the frame and a second position in which the support base can be removed from the frame.

6. The apparatus of claim 1, wherein the clamp support is intermediate between a first clamp member and a second clamp member, with the clamp members and clamp support reciprocally secured by a single clamp bolt mounted in a bolt hole in each clamp member and clamp support, and with at least one pressure spring positioned between the clamp members.

7. The apparatus of claim 1, further comprising a second apparatus for securing a vehicle to a vehicle repair system, with the second apparatus mounted on the work surface in a spaced relationship from the first apparatus.

8. An apparatus for securing a vehicle to a vehicle repair system with the vehicle repair system having a work surface, the apparatus comprising:

a means for mounting the apparatus on the work surface;

a means for retaining a vehicle;

an upright column coupled to the means for retaining a vehicle;

a means for supporting the upright column slidingly attached to the means for mounting;

a means for locking removably mounted on the means for supporting and engaging the upright column; and, a means for securing the means for locking against the means for mounting and drawing the means for supporting against the means for mounting, thereby fixing the apparatus to the work surface.

9. The apparatus of claim 8, wherein the means for securing is provided with a plurality of holes, which holes are engaged by a means for tightening to manipulate the means for securing.

10. The apparatus of claim 8 including a means for handling slidingly mounted on the means for supporting, with the means for handling having a first position in which the means for support remains attached to the means for mounting and a second position in which the means for supporting can be removed from the means for mounting.

11. The apparatus of claim 8, further comprising a second apparatus for securing a vehicle to a vehicle repair system, with the second apparatus mounted on the work surface in a spaced relationship from the first apparatus.

12. A method for securing a vehicle to a vehicle repair system having a work surface using an apparatus for securing a vehicle, the method comprising the steps of:

placing the vehicle on the work surface;

placing a frame on the work surface and aligning the frame with a vehicle securing area on the vehicle;

mounting a support base on the frame with the support base having an upright column;

sliding the support base along the frame to align with the vehicle securing area;

installing a lock plate having a lock plate bore, with the lock plate bore sliding over the upright column;

coupling a vehicle retainer to the clamp support, adjusting the clamp support and the vehicle retainer to engage the vehicle, locking the frame to the work surface using a tool, locking the vehicle retainer, to the vehicle using the tool; and, locking the support base to the frame by tightening the lock plate to the upright column using the tool.

13. The method of claim 12, including the step of selecting a vehicle retainer structured to retain the vehicle.

14. The method of claim 12, further comprising the step of mounting at least one additional apparatus for securing a vehicle on the work surface in a spaced relationship from the first apparatus.

15. The method of claim 14, including the steps of mounting a third and fourth apparatus for securing a vehicle on the work surface in a spaced relationship from each other and from the first and second apparatus; and repairing the vehicle secured to the vehicle repair system.

* * * * *